US006105180A

United States Patent [19]

Kramer

[11] Patent Number: 6,105,180

[45] Date of Patent: Aug. 22, 2000

[54] HEIGHT ADJUSTABLE FALSE BOTTOM FOR MULTI-PURPOSE POOLS

[75] Inventor: Klaus Kramer, Wilhelmshaven, Germany

[73] Assignee: KBE Bauelemente GmbH & Co. KG, Wilhelmshaven, Germany

[21] Appl. No.: 09/169,040

[22] Filed: Oct. 9, 1998

[30] Foreign Application Priority Data

Oct. 16, 1997 [DE] Germany ..... 197 45 746

[51] Int. Cl.[7] ..... E04H 4/00

[52] U.S. Cl. ..... 4/495; 4/488; 4/506; 254/92

[58] Field of Search ..... 4/495, 501, 504, 4/488, 496, 506; 254/91, 92, 98, 102, DIG. 8, DIG. 9

[56] References Cited

U.S. PATENT DOCUMENTS

| | | | |
|---|---|---|---|
| 2,555,804 | 6/1951 | McCarthy | 254/92 X |
| 3,041,631 | 7/1962 | Fogle | 4/495 |
| 4,229,843 | 10/1980 | Belanger | 4/495 |
| 4,419,776 | 12/1983 | Schmidt | 4/495 X |
| 4,918,766 | 4/1990 | Leonaggeo, Jr. | 4/495 |
| 5,156,238 | 10/1992 | Matthews | 254/89 R X |
| 5,678,253 | 10/1997 | Baker | 4/495 |
| 5,755,310 | 5/1998 | Wourms | 254/98 X |

FOREIGN PATENT DOCUMENTS

| | | |
|---|---|---|
| 712976 | 5/1996 | European Pat. Off. . |
| 2261404 | 6/1974 | Germany . |

*Primary Examiner*—Henry J. Recla
*Assistant Examiner*—Kathleen J. Prunner
*Attorney, Agent, or Firm*—Baker & Maxham

[57] ABSTRACT

A height adjustable false bottom for multi-purpose pools. The apparatus has a device for adjusting the height of the false bottom, where a plurality of supporting legs, which are pivotable and have a variable length, are used for the height adjustment. The supporting legs are preferably formed as rotatable spindle drives.

12 Claims, 8 Drawing Sheets

HEIGHT ADJUSTABLE FALSE BOTTOM FOR MULTI-PURPOSE POOLS

BACKGROUND OF THE INVENTION

1. Field of the Invention

This invention relates generally to height adjustable false bottoms for pools, and more particularly to an improved apparatus for effectively and efficiently raising and lowering the false bottom.

2. Discussion of the Related Art

Such height adjustable false bottoms are used in particular in swimming pools or multi-purpose pools, where the depth of the pool is to be adjusted to different requirements by means of the height adjustable false bottom. The height adjustment is often made while the pool is filled with water.

A height adjustable false bottom of the general type in question is disclosed in German patent 2,261,404. That German patent document is incorporated herein by reference. That German reference describes one possibility of a making an adjustment by means of supporting legs of invariable length, attached undisplaceably to the false bottom at their upper ends. The lower ends are moved by a suitable drive, especially a spindle drive, thereby achieving an adjustment of the height of the false bottom. This system functions generally satisfactorily in operation.

One disadvantage of the apparatus disclosed in that reference, however, is that a relatively long period of time is required to achieve the total lift. Specifically, a period of about 12 minutes is required with these known systems to travel a height of about two meters. Furthermore, this lifting operation does not always proceed uniformly. Depending on the position of the supporting legs, the false bottom is raised either rapidly or slowly. A disproportionately long period of time is required, especially for lifting the false bottom into the topmost position.

Another disadvantage of the prior apparatus is that the minimum structural height of this height adjusting device is about 700 mm. This means that excavation for the pool must be more than 0.7 m deeper in the area of the height adjusting device, with appropriate waterproof lining accordingly.

In addition, there are also known hydraulic systems consisting essentially of a vertically arranged hydraulically operated jack supporting the false bottom. These systems can handle much larger forces, but they are expensive to manufacture and also require high maintenance. One serious disadvantage of these hydraulic systems is that the gaskets used are not completely oil-tight. Thus they necessarily cause contamination of the water. This contamination is substantial. Under normal operation, 30 liters of fresh water are added to a pool per swimmer in a certain period of time. This value increases to 300 liters when these hydraulic lift systems are used.

SUMMARY OF THE INVENTION

It is a primary purpose of the present invention to improve upon a height adjustable false bottom of the type defined above to the extent that it can be raised and lowered much more rapidly, permits a more uniform height adjustment and is inexpensive to manufacture and maintain.

It is essential here that the height adjustment of the false bottom is now accomplished by a plurality of supporting legs which are pivotable and have a variable length. The articulation points of the supporting legs are fixed with respect to the height adjustable false bottom and also with respect to the bottom.

With the structure of the present invention, raising and lowering can be performed much more rapidly, because the change in length of the supporting legs acts much more directly on the height adjustment of the false bottom than does the displacement of articulation points according to the German patent document identified above.

A common drive is preferably provided for all the supporting legs and may also be installed in the interior space between the supporting legs. The supporting legs themselves are preferably designed as spindles. These spindles are rotated, each spindle thereby displacing the respective tube surrounding it. To increase buckling resistance, it is additionally possible for the spindles to be provided with a bearing with respect to the surrounding tube on their free ends. This bearing is preferably designed as a ring provided with rotatable rollers. These rollers may then be supported on the inside of the tube.

On the opposite end, each supporting leg is mounted in an essentially U-shaped flange. This flange is pivotable, thereby permitting a corresponding pivoting movement of the supporting leg. The bearings used are preferably designed as sleeve bearings. This has the important advantage that the risk of contamination of the water flowing around the entire lifting mechanism is minimized. Therefore, a coating of the spindles, for example, may be used in combination with a special parameter, which has already been used in the design of the previously mentioned German patent.

As an alternative, it is of course also possible to use encapsulated roller bearings.

In a refinement of this invention, the supporting legs may also be designed as telescoping legs, to permit greater lifting heights. Therefore, two intermeshing spindles which can be linked across a stop are provided. The spindles preferably have the same thread pitch, although this is not absolutely essential, and different thread pitches may also be used. To keep manufacturing costs low, the second spindle used is preferably designed as a thick-walled tube with an outside thread. This thread may be turned, for example.

BRIEF DESCRIPTION OF THE DRAWING

The objects, advantages and features of the invention will be more clearly perceived from the following detailed description, when read in conjunction with the accompanying drawing, in which.

DETAILED DESCRIPTION OF THE PREFERRED EMBODIMENTS

Figure 1:
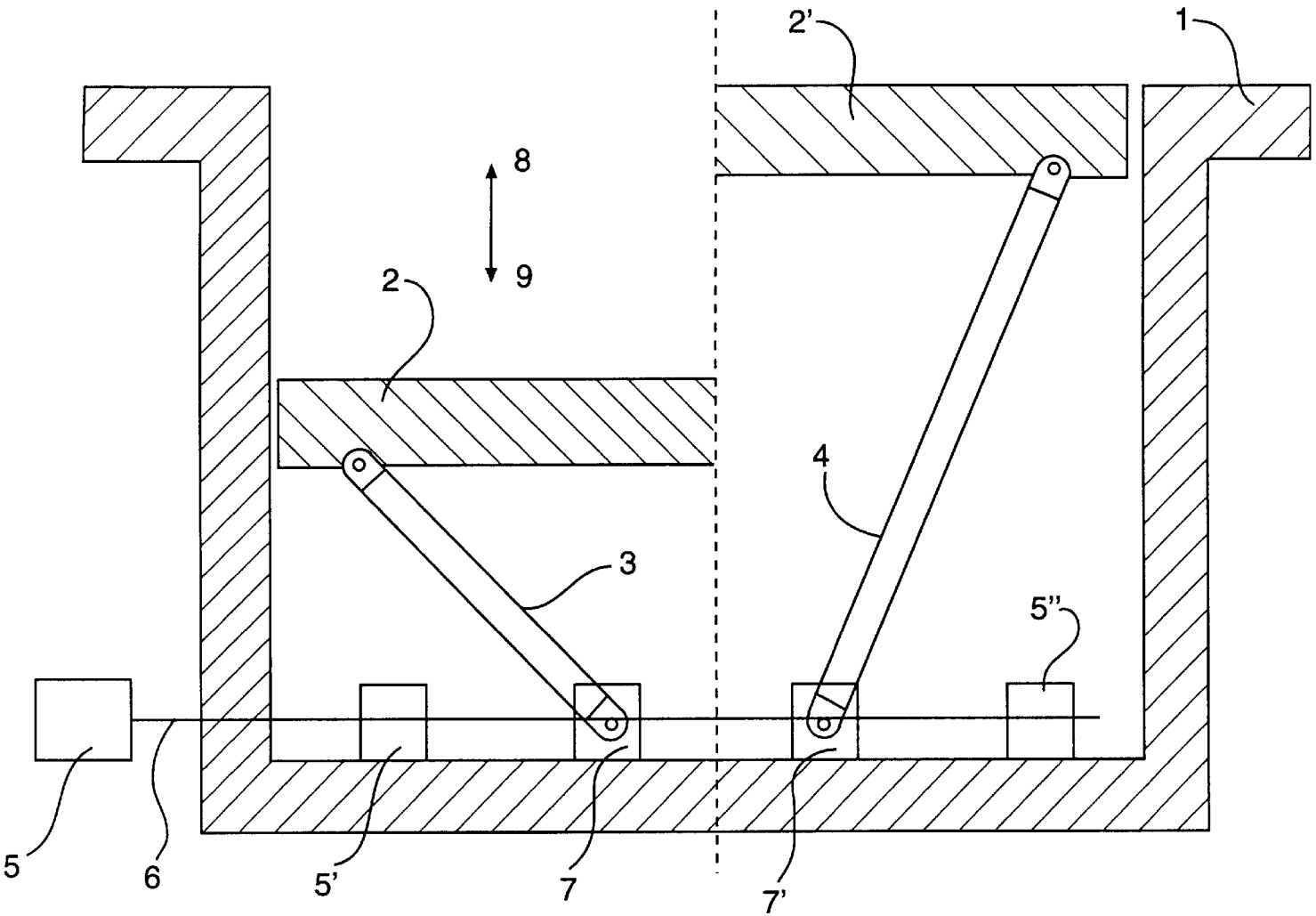
FIG. 1 is a section through an embodiment of the present invention which is currently preferred, showing the false bottom at two alternative levels.

With reference now to the drawing, and more particularly to FIG. 1, height adjustable false bottom 2 is shown in pool 1 at an intermediate level. In the left half of FIG. 1, this false bottom 2 is shown approximately in the middle, and in the right half false bottom 2' is shown on its topmost position.

The height is adjusted by means of supporting legs 3, 4 which are mounted pivotably and have a variable length. A motor 5 is used to drive the supporting legs by means of shaft 6. Motor 5 may be installed outside the pool, as illustrated here, or inside the pool (5', 5"), and optionally even between supporting legs 3, 4.

Articulation points 7, 7' of supporting legs 3, 4 are fixed with respect to the bottom of the pool. With the design shown here, false bottom 2 may be moved in the direction of arrows 8, 9.

Figure 2:
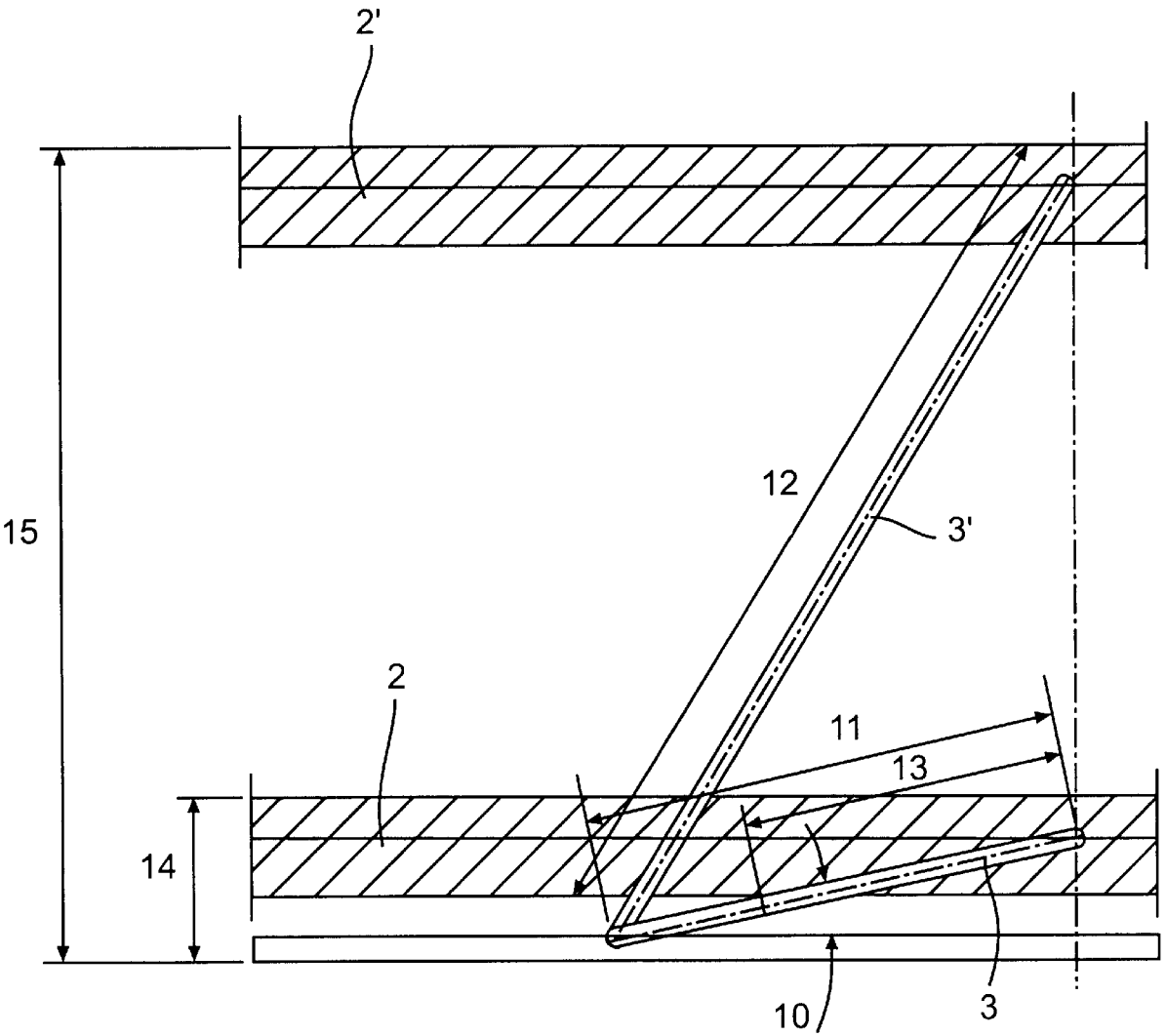
FIG. 2 is an enlarged detail from FIG. 1.

FIG. 2 shows an enlarged detail of a portion of FIG. 1. It can be seen clearly here that angle 10, assumed by supporting leg 3 in its shorted position (length 11) increases accordingly as the false bottom is raised. Length 12 is also increased when supporting leg 3 is in its extended position 3'.

When using spindle drives, a spindle path 13 of approximately 1200 mm is preferably assumed. The minimum length 11 is approximately 1630 mm in this case, while the maximum length 12 is approximately 2810 mm. This yields a minimum height 14 of approximately 500 mm, corresponding to an angle 10 of approximately 11°. Height 14 may also be reduced to approximately 400 mm through various design features; angle 10 then achieves a value of slightly more than 9°. In the embodiment shown here, the maximum height 15 is approximately 2500 mm. Thus, this yields a lift of approximately two meters.

Figure 3:
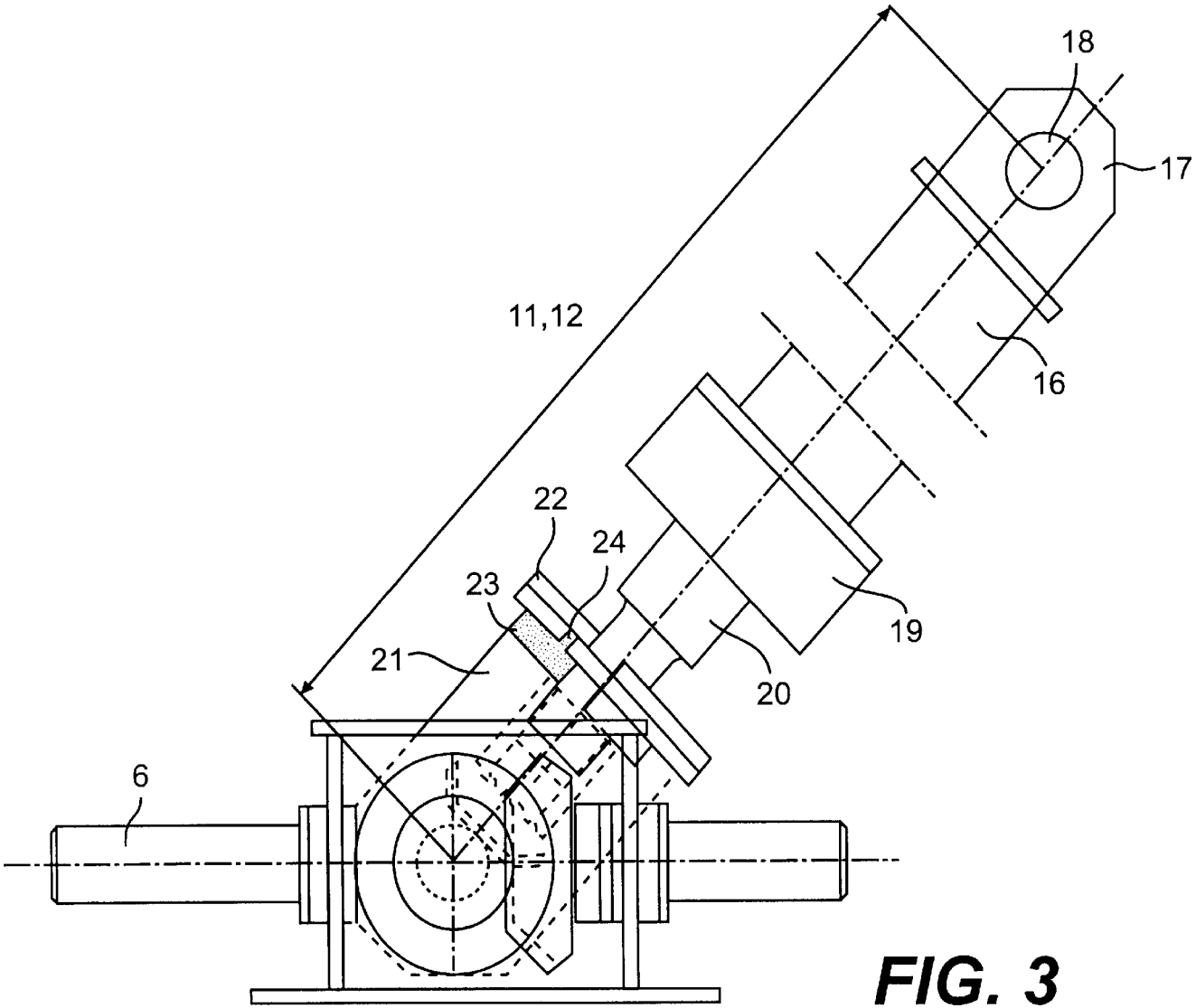
FIG. 3 is a side view of the bearing of a supporting leg.
Figure 4:
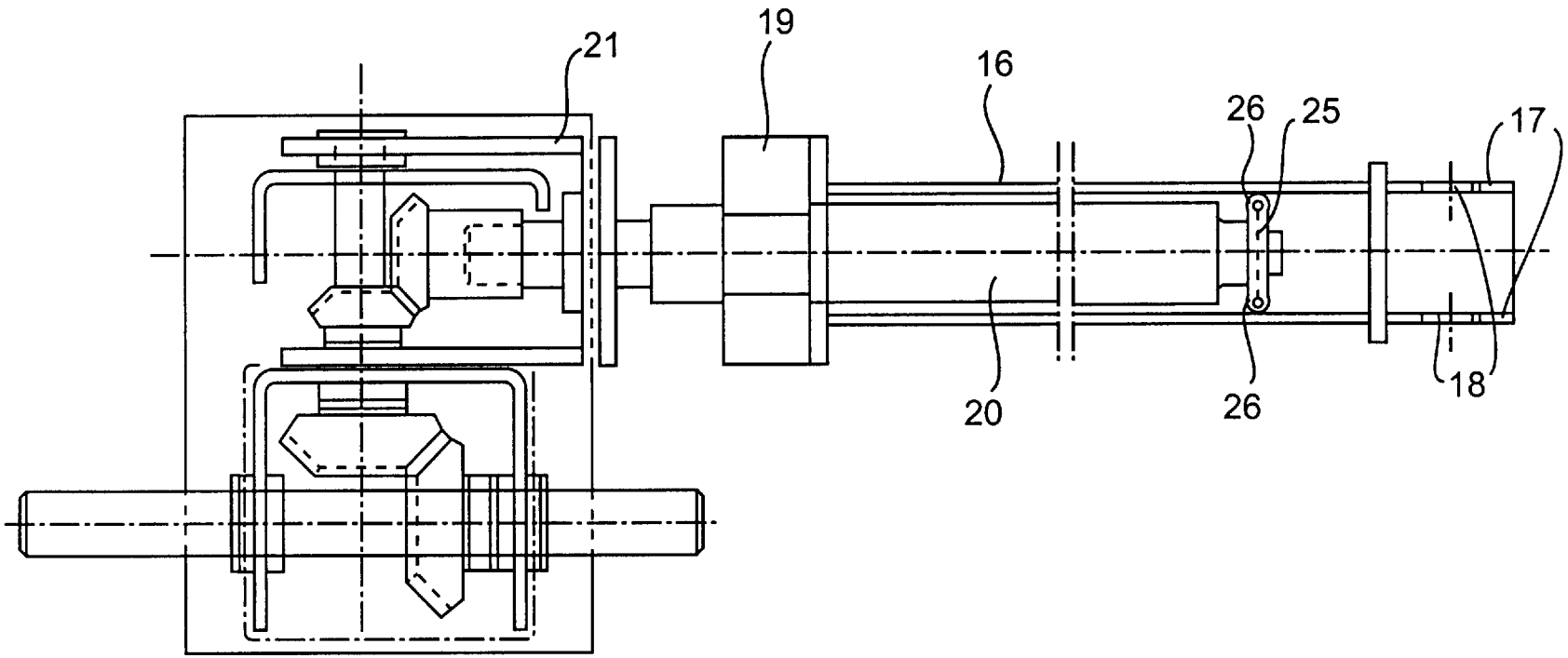
FIG. 4 is a top view of FIG. 3.

FIGS. 3 and 4 show the bearing and mounting of supporting leg 3 and the drive concept employed. The supporting leg has a tube 16 which is provided at its upper end with a flange 17 and a respective opening 18. With the help of this opening 18, tube 16 is mounted on false bottom 2 in a rotationally fixed manner. On the opposite end, tube 16 is provided with nut 19. This nut is preferably made of a special material which has already been used in the aforementioned German patent 2,261,404. Therefore, no further description will be given here.

Spindle 20, which passes through nut 19, is rotatably mounted in an essentially U-shaped flange 21. In the embodiment shown here, the bearing is provided by two flanges 22, 23, which carry a bearing 24 between them in the form of a sleeve bearing. It is, of course, also possible to use suitable ball bearings.

When shaft 6 is rotated, this rotational motion is transmitted to spindle 20 by way of the respective gear wheels. Since nut 19 is designed to be rotationally fixed over tube 16, it is displaced with respect to spindle 20. In this way a change in length is achieved, automatically resulting in pivoting.

The bearing of flange 21 on the respective elements may in turn be designed as a sleeve bearing or a roller bearing.

Although it is not absolutely essential for the free end of spindle 20 to be guided, in individual cases this may definitely be necessary. For example, FIG. 4 shows that this free end is provided with a ring 25 which in turn carries rollers 26. These rollers 26 are in contact with the inside wall of tube 16 and thus support spindle 20. A sleeve bearing may, of course, also be used here.

Figure 5:
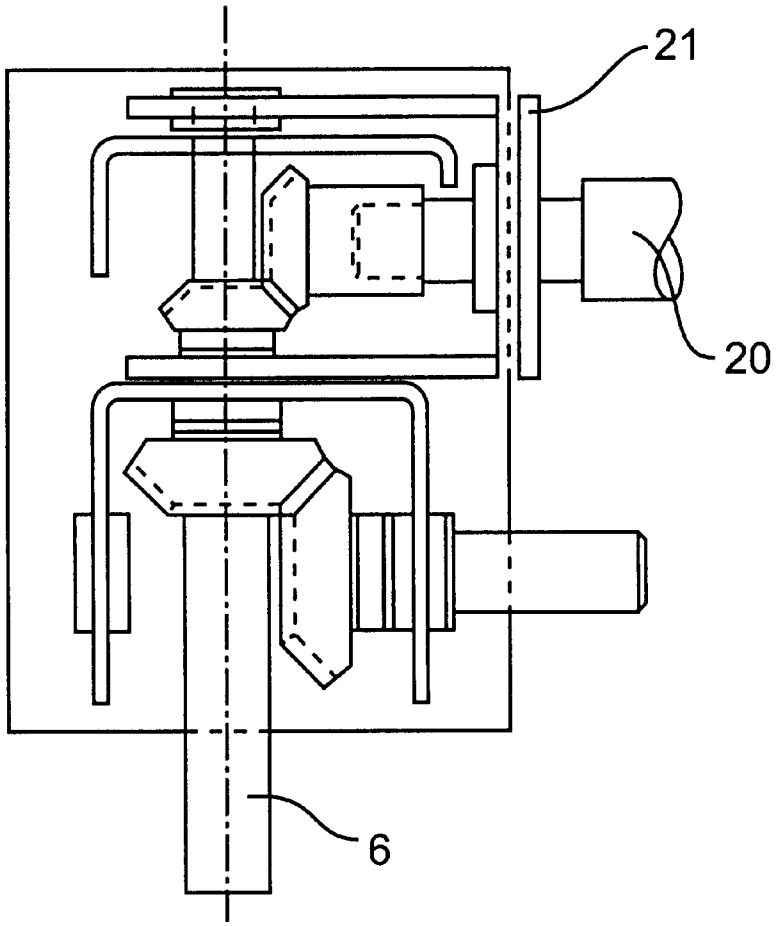
FIG. 5 is another embodiment of the drive in a view similar to that in FIG. 4.

FIG. 5 shows a modified drive form. The drive shaft 6' is shown here with its position rotated 90° with respect to FIG. 4. No detailed description of FIG. 5 will be given here, because it is similar to FIGS. 3 and 4.

Figure 6:
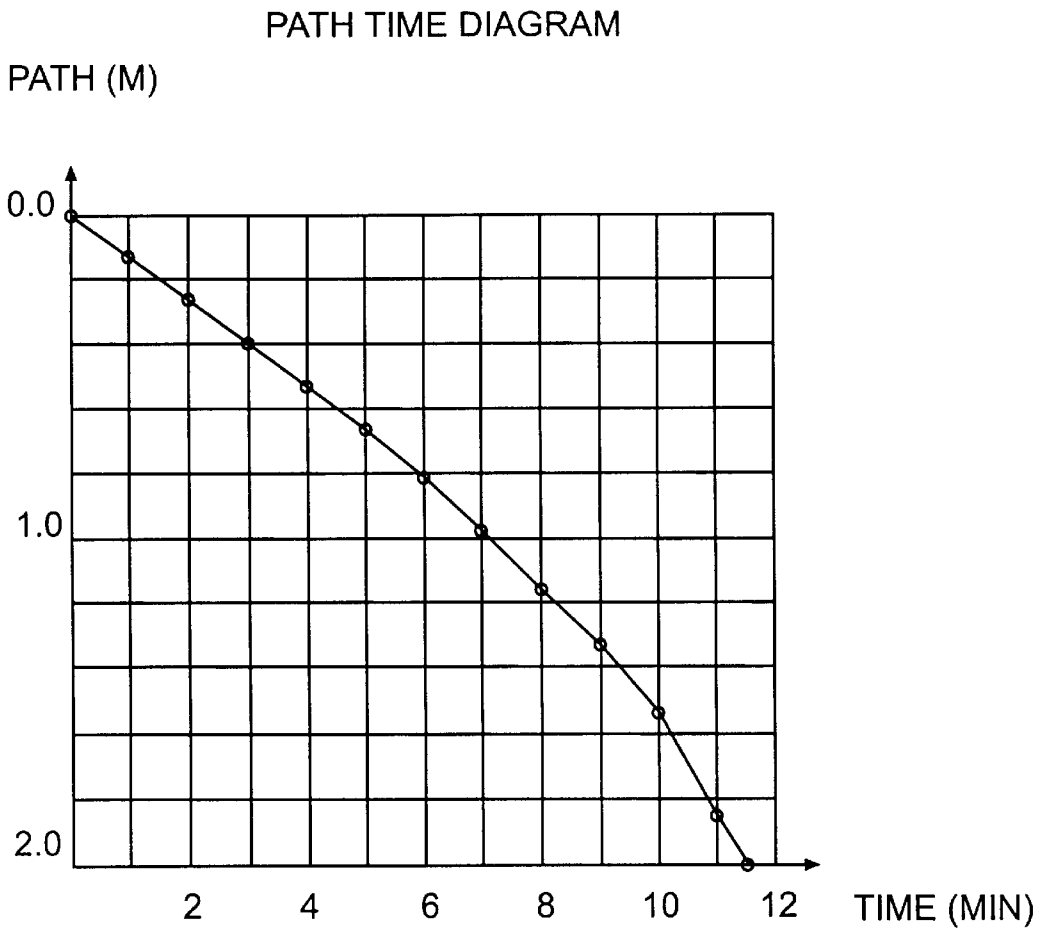
FIG. 6 is a path-time diagram of the height adjustment.

FIG. 6 shows a path-time diagram. This diagram shows clearly that false bottom 2 moves essentially uniformly over a very large lifting range. There is a slight increase in lifting speed only just before reaching the maximum lift. The total time required may be reduced by one-half by using a motor with a higher power, thereby ensuring that supporting legs 3, 4 can be extracted and retracted more rapidly.

Figure 7:
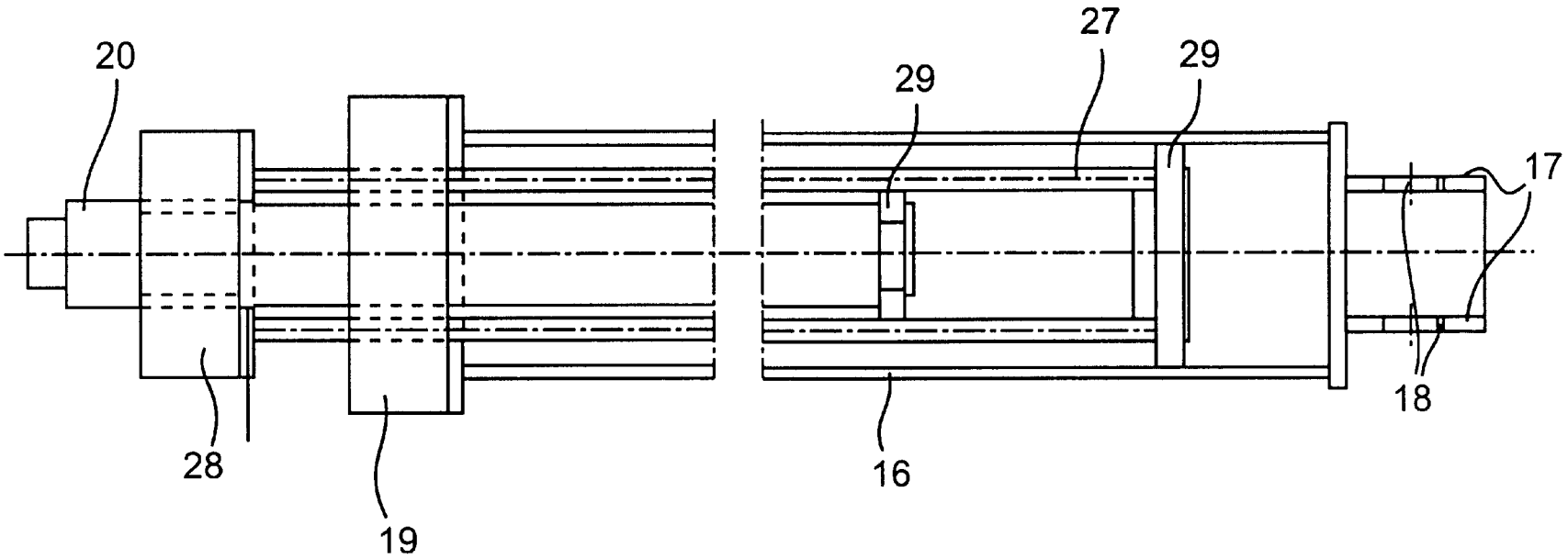
FIG. 7 is a view like that in FIG. 4 through a telescoping supporting leg.
Figure 8:
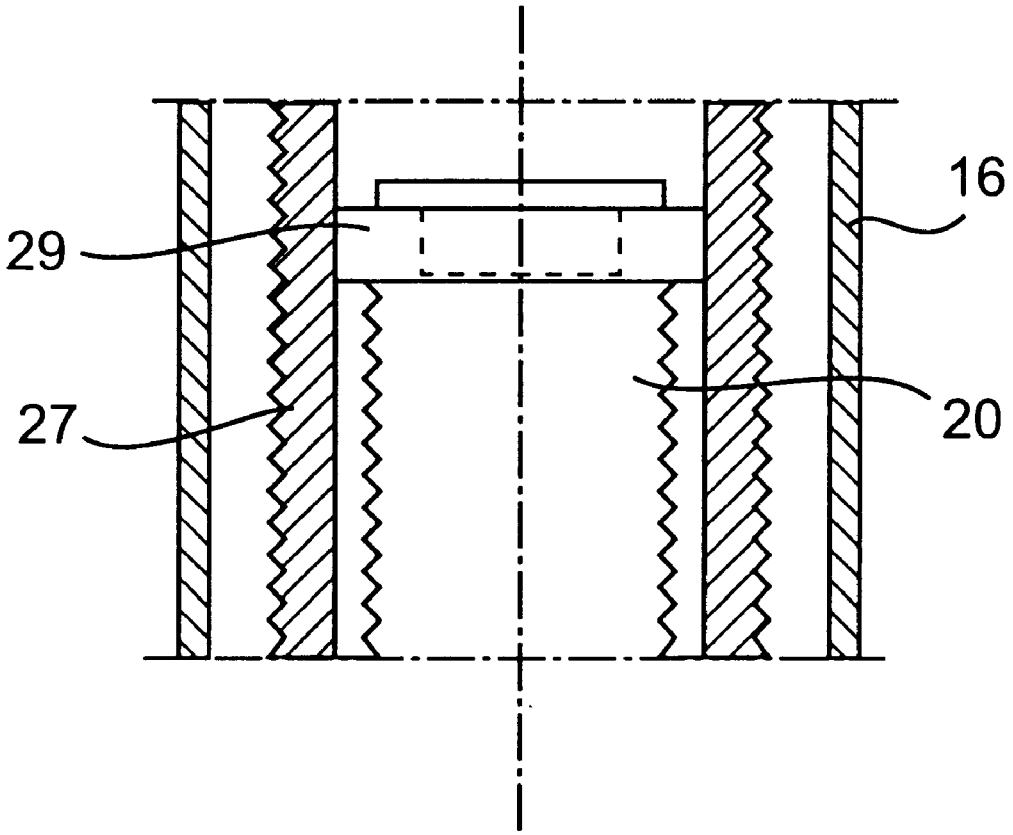
FIG. 8 is an enlarged view of the threaded spindles.

FIG. 7 shows another embodiment where the supporting leg is designed as a telescoping leg. To do so, first spindle 20 is surrounded by second spindle 27. Second spindle 27 is designed as a thick-walled tube with an outside thread. On the inside, spindle 20 is supported on spindle 27 by projection 29 which may be constructed similar to that shown in FIG. 4. A corresponding support is provided for spindle 27 in tube 16. Spindle 27 is connected in a rotationally fixed manner to nut 28 which engages with spindle 20. Tube 16 is in turn connected in a rotationally fixed manner to nut 19, which engages with spindle 27.

The inside spindle 20 is rotated, thereby displacing nut 28 which is provided with an inside thread. With a suitable design, nut 19 also rotates with the spindle, so that outside spindle 27 also causes a change in length at the same time. On reaching the maximum change in length, projections 29 of spindles 20, 27 are in contact with respective nuts 19, 28.

If nut 19 does not rotate with the spindle, projection 29 of spindle 20 is in contact with nut 28 after a certain change in length, preventing any further mutual turning. The rotation applied by motor 5 then acts on nut 19 by way of the rotationally fixed connection of projection 29 and nut 28. This nut is then rotated thereby displacing tube 16 by means of spindle 27.

As an alternative design, the outside spindle may also be provided with an inside thread which engages directly with the inside spindle.

On the whole, the design according to the present invention yields a much more rapid and uniform adjustment of the false bottom, which is also practically maintenance free and does not cause contamination of the pool. In view of the above description it is likely that modifications and improvements will occur to those skilled in this technical field which are within the scope of this invention. Therefore, the invention is to be limited only by the spirit and scope of the appended claims and their equivalents.

What is claimed is:

1. In a height adjustable false bottom for pools, an apparatus for adjusting the height of a false bottom with respect to the bottom of the pool, the apparatus comprising:

a plurality of supporting legs, each having a longitudial axis, each leg comprising a substantially rotatable spindle along its longitudial axis, each said leg being pivotable and veriable in length;

means for coupling one end of each said supporting leg to an individual location on the bottom of the pool;

means for coupling the other end of each said supporting leg to an individual location on the false bottom;

each said one end and each said other end being substantially immovable with each individual location, respectively; and means for actuating said supporting legs to adjust the height of the false bottom with respect to the bottom of the pool.

2. The apparatus according to claim 1, wherein said means for actuating comprises a common drive for all said supporting legs.

3. The apparatus according to claim 2, wherein said drive is installed outside the pool.

4. The apparatus according to claim 1, wherein each said supporting leg has a spindle which can be rotated and a respective tube surrounding said spindle to be displaced with respect to said spindle.

5. The apparatus according to claim 4, wherein said spindle is provided at its free end with a ring with respective rollers which are supported on the inside of said tube.

6. The apparatus according to claim 1, wherein each said supporting leg is mounted in an essentially U-shaped flange which is in turn mounted pivotably with respect to the bottom of the pool.

7. The apparatus according to claim 1, wherein said means for coupling said one end comprises bearings formed as sleeve bearings or roller bearings.

8. The apparatus according to claim 1, wherein said supporting legs have a telescopic configuration.

9. The apparatus according to claim 8, wherein each said supporting leg is provided with two spindles, which engage with one another, and with a stop which connects said two spindles to one another in a rotationally fixed manner in one direction of rotation when these two said spindles reach a certain position relative to one another.

10. The apparatus according to claim 9, wherein said two spindles are each provided with threads of the same pitch.

11. The apparatus according to claim 10, wherein the second of said two spindles is designed as a thick-walled tube with an outside thread.

12. The apparatus according to claim 9, wherein the second of said two spindles is designed as a thick-walled tube with an outside thread.

* * * * *